US005566942A

United States Patent [19]

Elum

[11] Patent Number: 5,566,942

[45] Date of Patent: Oct. 22, 1996

[54] CROSSWORD PUZZLE GAME AND METHOD OF GENERATING THE SAME

[76] Inventor: Charles R. Elum, 1772 State Rd., Cuyahoga Falls, Ohio 44223

[21] Appl. No.: 534,036

[22] Filed: Sep. 26, 1995

[51] Int. Cl.[6] ..... A63F 9/00

[52] U.S. Cl. ..... 273/153 R; 273/272; 434/177

[58] Field of Search ..... 273/153 R, 157 R, 273/272, 299; 434/177, 170, 171, 172, 159, 160, 162, 167

[56] References Cited

U.S. PATENT DOCUMENTS

| | | | |
|---|---|---|---|
| 1,625,218 | 4/1927 | Lundy | 434/177 |
| 1,769,961 | 7/1930 | Norrell . | |
| 2,055,159 | 9/1936 | Scofield . | |
| 2,239,970 | 4/1941 | Osborne . | |
| 2,703,459 | 3/1955 | Paquette . | |
| 2,795,863 | 6/1957 | Warwick . | |
| 3,072,407 | 1/1963 | Olson . | |
| 3,290,800 | 12/1966 | Le Dell . | |
| 3,565,439 | 2/1971 | Krouse et al. . | |
| 3,811,206 | 5/1974 | Gaccetta . | |
| 3,863,931 | 2/1975 | Forsyth et al. . | |
| 3,891,218 | 6/1975 | Hilgartner . | |
| 4,106,773 | 8/1978 | Coefield . | |
| 4,179,126 | 12/1979 | Coefield . | |
| 4,205,852 | 6/1980 | Wayman . | |
| 4,209,173 | 6/1980 | Curtis et al. . | |
| 4,299,578 | 11/1981 | Wayman . | |
| 4,369,973 | 1/1983 | D'Aurora et al. . | |
| 4,448,423 | 5/1984 | Augusta | 273/272 |
| 4,625,971 | 12/1986 | Furguson . | |
| 4,828,499 | 5/1989 | Modzak . | |
| 4,850,595 | 7/1989 | Sherman et al. . | |
| 4,907,807 | 3/1990 | Lee et al. . | |
| 5,149,097 | 9/1992 | Tonello et al. . | |

FOREIGN PATENT DOCUMENTS

| | | | |
|---|---|---|---|
| 2117255 | 10/1983 | United Kingdom | 273/272 |
| 2251805 | 7/1992 | United Kingdom | 273/272 |

OTHER PUBLICATIONS

E. R. Galli, "Right Angles", Games, pp. 37 and 64.

*Primary Examiner*—Steven B. Wong

*Attorney, Agent, or Firm*—Oldham & Oldham Co LPA

[57] ABSTRACT

This invention relates generally to crossword puzzle type games, and more particularly to an improved crossword puzzle game and method of creating an improved crossword puzzle type game wherein additional indicia is provided on the crossword puzzle answer grid to assist the game player in determining the correct answer to the ordinary written clues provided. The additional clues provided on the answer grid preferably take the form of added indicia within one or more of the squares that form the answer grid. For example, the added indicia may be in the form of different color squares, squares including designs therein, and any other suitable indicia. A key is provided such that a player can determine the meaning of each type of added indicia. The indicia can give a player clues to assist the player in completing the puzzle. For example, one type of indicia may indicate that a vowel is to be placed in a square, while another type of indicia may indicate that a consonant is to be placed in a square. Numerous types of indicia with different meanings may be provided in different squares on any one crossword puzzle. The invention also relates to a method of generating such an improved crossword puzzle type game.

21 Claims, 2 Drawing Sheets

CROSSWORD PUZZLE GAME AND METHOD OF GENERATING THE SAME

FIELD OF INVENTION

This invention relates generally to crossword puzzle type games, and more particularly to an improved crossword puzzle game and method of creating an improved crossword puzzle type game wherein additional indicia is provided on the crossword puzzle answer grid to assist the game player in determining the correct answer to the clues provided.

BACKGROUND OF THE INVENTION

Crossword puzzle games are well known and have long provided an educational and entertaining activity for millions of people. In a typical crossword puzzle game, an answer grid is provided which comprises a plurality of interconnected squares or cells. The squares are arranged in rows and columns and each square is designed to contain one letter of an answer to at least one provided clue. Certain squares within the grid are numbered to indicate a correspondence between particular clues and the squares in which the answers to those clues are to be written or otherwise indicated. The number of letters in the answer to each clue must fit exactly in the number of squares provided on the answer grid for the answer to that clue. Due to the matrix form of the answer grid, the various answers intersect one another so that some or all of the letters forming an answer also form part of at least one and typically several other answers. For example, the letters of a horizontal answer can form part of numerous vertical answers that intersect the horizontal answer.

Crossword puzzle games are provided for all different ages and levels of knowledge. Certain puzzles may be too easy for some players, while other puzzles are difficult for even experienced and knowledgeable players. For many players, it is difficult to find crossword puzzle games that are sufficiently difficult to be challenging, yet not impossible to complete without repeated reference to the answer key. Also, in certain instances, the answer key is not provided with the puzzle and is only available at a later date. It is believed that many more people would play crossword puzzle games if a crossword puzzle game could be developed that was sufficiently difficult to be challenging to players, while at the same time, providing encouragement and clues to the player that a particular answer may be correct, without requiring that player to look at an answer key.

SUMMARY OF THE INVENTION

The present invention is therefore directed to a crossword puzzle game comprising an answer grid upon which a player may indicate an answer or solution to a provided clue wherein the answer grid has a plurality of interconnected squares each designed to contain one letter of at least one of the answers to the clues, and wherein at least one of the squares includes additional indicia indicating that the letter to be placed in that square is to be selected from a particular subset of an alphabet. A list of written clues provides information with respect to an answer to be placed on said answer grid by said player.

The present invention also relates to a method of generating a crossword puzzle type game comprising the steps of generating a plurality of clues from each of which a player can determine an answer, providing an answer grid having a plurality of interconnected squares each designed to contain one letter of at least one answer whereupon a player may indicate an answer to each of the provided clues, and placing added indicia within at least one of the squares to indicate to a player information regarding the proper letter to be placed in that square to assist the player in determining the proper answer to at least one of the provided clues.

DETAILED DESCRIPTION OF THE INVENTION

Figure 1:
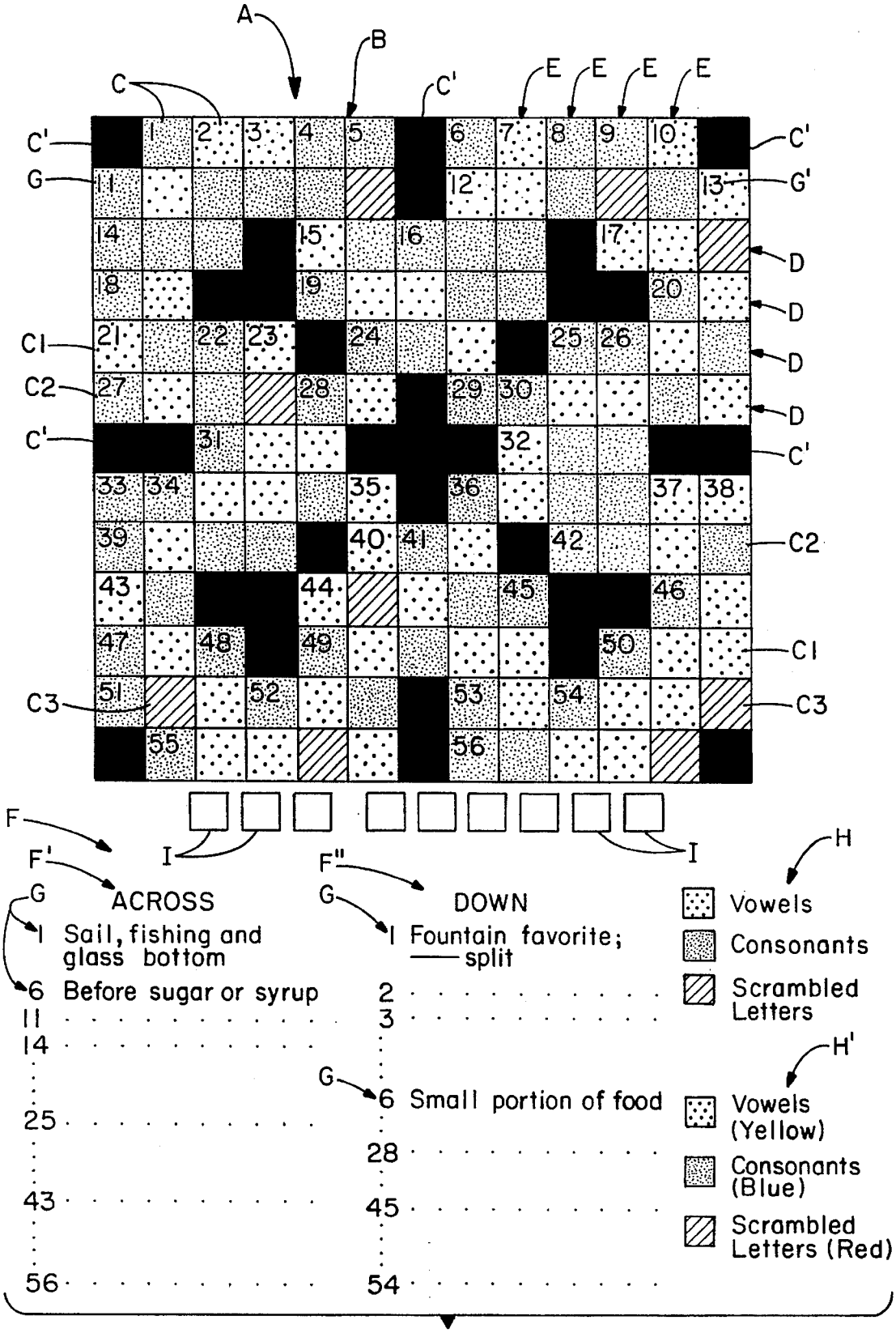
FIG. 1 shows a crossword puzzle game in accordance with the present invention.

Referring to FIG. 1, a crossword puzzle game in accordance with the present invention is shown at A and comprises generally an answer grid B upon which a player's answers are to be written or otherwise indicated, and a list F containing a plurality of clues that assist a player in determining the proper answers to be placed on answer grid B. Answer grid B may be provided in many different forms such as in the form of a game board designed to accept letter pieces in each square, an electronic display, computer software, or any other suitable form. Preferably, however, answer grid B and list of clues F are printed on paper such that answers may be written on grid B with a pen or pencil. The answer grid B comprises a plurality of interconnected cells or squares C wherein each square C is designed to contain one particular letter of an alphabet (of any language) when the answer grid B is completely full of correct answers as is described below. Grid B also contains blocked out or darkened squares C' that are provided as separators or filler only, and darkened squares C' are not designed to contain any letters of the answers to the completed crossword puzzle A.

In the example shown, squares C are arranged in intersecting horizontal rows D and vertical columns E such that a letter placed in a square C may form a part of more than one answer written on the answer grid B. A list of clues F is provided and, in the example shown, comprises two sublists of clues—the "ACROSS" sublist F' and the "DOWN" sublist F". Each sublist F',F" includes a plurality of clues that are identified with clue numbers G. Each clue is designed to provide a crossword puzzle player with sufficient information such that the player can choose the appropriate answer to that clue and place the answer on the answer grid B. To ensure that the player knows in which square C a particular answer is to be written, the square C that is to contain the first letter of each answer is numbered with a square number G' that is the same number as at least one clue number G. If a clue is selected from the "ACROSS" sublist F', then the answer must be written in a horizontal row D of squares C with the first letter of the answer being located in the square C that has a square number G' that is the same as the clue number G. Likewise, if a clue is selected from the "DOWN" sublist F", then the answer to that clue must be written in a vertical column E of squares C with the first letter of the answer being located in the square C that has a square number G' that is the same as the clue number G. In either case, the number of letters in the answer must exactly correspond to the number of squares C provided for the answer on grid B. As is noted above, when an answer is written in any of squares C, each constituent letter of that answer may form a part of another answer and typically forms part of several other answers.

To provide a crossword puzzle that is sufficiently challenging but capable of being completed without excessive difficulty, and that is also fun and exciting, the crossword puzzle of the present invention A includes added indicia in at least one, and preferably in numerous squares C that provides additional clues to the player with respect to the type of letter that is to be-entered in that particular square C. This added indicia can take many forms, and can inform the player of any one or more additional clues to the proper entry for each square C, for example, that the letter to be entered in that square C is to be selected from a particular subset of an alphabet. In the example shown in FIG. 1, each square C includes added indicia that provides a player with clues with respect to the proper type of letter to be placed in that square C. As shown, each square C contains added indicia in the form of either cross-hatching, large dots, or shading. Other designs of added indicia in squares C are contemplated, and the invention is not meant to be limited to the particular dots, shading, and cross-hatching shown. A key H is preferably provided to indicate to a player the meaning of each different type of added indicia. It can be seen from key H in the example shown in FIG. 1, that a square C1 having large dots as added indicia is designed to contain only a vowel (a,e,i,o,u, and sometimes y) while shaded squares C2 are designed to contain only consonants (all letters of the alphabet that are not vowels).

Squares C3 having cross-hatching as added indicia denote squares C in which letters are to appear, such that after all of the squares C3 that have cross-hatching are filled in with letters, the player may select those letters and try to assemble a word therefrom that fits exactly into the bonus squares I that may be provided wherein the word satisfies a particular extra or bonus clue that may be provided. For example, bonus squares I may be designed to contain the name of a famous person that is to be assembled from the letters found in the squares C3 having cross-hatching as added indicia.

Figure 2:
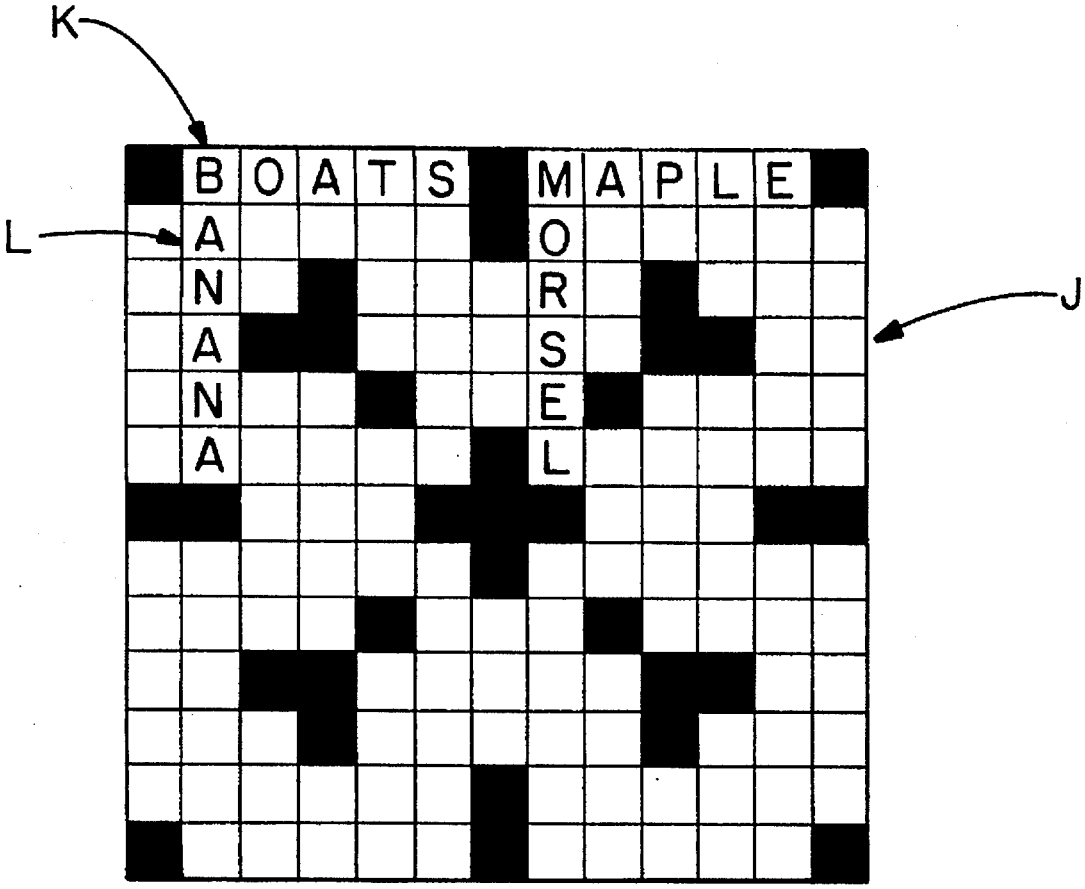
FIG. 2 shows a crossword puzzle game answer key.

For example, the written clue having a clue number G of 1 selected from the "ACROSS" sublist F' reads "Sail, fishing and glass bottom". If not for the present invention A, the player may debate between the answers "SHIPS" and "BOATS", either word having the proper number of letters to fit in the squares C provided for the answer to this clue. However, choosing the answer "SHIPS" could result in incorrect responses or at least difficulty in selecting answers to the clues having clue numbers G of 1–5 selected from the "DOWN" sublist F". However, as a result of the present invention, the further clues provided by the added indicia indicate that the second and third letters of the preferred answer to this clue must be vowels, thereby indicating that the answer "BOATS" is the correct selection. A partially completed answer key J is shown in FIG. 2, wherein the proper answer "BOATS" is shown at K in the squares C provided. It can be seen in FIG. 2 that the correct answer "BOATS" provides the basis for the correct answer "BANANA" (shown at L) to the first clue selected from the "DOWN" sublist F" whereas the incorrect answer "SHIPS" would not provide the proper basis for the answer L "BANANA".

It can be seen from the foregoing that a wide variety of added indicia may be utilized within some or all of squares C to assist a player, and the invention is not meant to be limited to the particular arrangement shown in FIG. 1. For example, in another preferred embodiment, added indicia in squares C may take the form of providing at least one, and preferably a plurality of squares C with different colors that provide the player with additional information regarding the type of letter to be inserted in the colored square C. As is shown in the key H' of FIG. 1, for example, squares C that should ultimately contain vowels may be colored yellow (indicated in FIG. 1 by a large dot pattern in the squares C1), squares C that should ultimately contain consonants are colored blue (indicated in FIG. 1 by a shading pattern in the squares C2), and the letters to be unscrambled and inserted into bonus squares I are to be located in squares colored red (indicated in FIG. 1 by cross-hatching in the squares C3). Any other colors or other indicia may be utilized, and any meaning may be assigned to those colors or other indicia. The added indicia in the squares C can be used to represent virtually any subset of any alphabet. For example, one type of indicia in squares C may indicate that those squares are to contain a letter selected from the group of letters in the first half of an alphabet, for example, from the letters A–M of the English alphabet, while another type of indicia (or lack of any added indicia—i.e., blank space) in the remaining squares C indicates that those squares are to contain letters from the group of letters forming the second half of an alphabet, for example, the letters N–Z of the English alphabet. Still another embodiment of the present invention could feature a keyword or puzzle title in which the letters contained in the keyword or in the title to the puzzle, and also appearing in the completed puzzle, are denoted with certain indicia in the appropriate squares C so as to provide the player with a further clue as to the identity of the proper word fitting into the assigned squares C. Numerous other types of added indicia are contemplated within the scope of the present invention, and the invention is not meant to be limited to the particular types of indicia shown herein.

It can be seen from the foregoing that the present invention also describes a method of generating an improved crossword puzzle type game in accordance with the present invention wherein a plurality of clues F are provided to give a player information with respect to the correct answers to be placed on a provided answer grid B of interconnected squares C. As is noted above, answer grid B may be formed from any of a wide variety of materials, and the invention is not meant to be limited to any particular material such as paper. At least one square C of answer grid B is enhanced with added indicia as is described above, and a key is provided to thereby create a crossword puzzle type game in accordance with the present invention. A bonus clue and bonus squares I may also be provided if desired, and added indicia may be placed in at least one square C to help a player determine the correct answer to the bonus clue by indicating that the letter in the square with the added indicia is also part of the answer to the bonus clue.

While the foregoing description has set forth the preferred embodiments of the invention in particular detail, it must be understood that numerous modifications, substitutions and changes can be undertaken without departing from the true spirit and scope of the present invention as defined by the ensuing claims.

What is claimed is:

1. A crossword puzzle game comprising:

an answer grid upon which a player may indicate an answer to a provided clue comprising a plurality of interconnected squares wherein each of said squares is designed to contain one letter of at least one of said answers to said clues, and wherein at least one of said squares includes additional indicia indicating that the letter to be placed in said at least one square is to be selected from a particular subset of an alphabet, said subset comprising a plurality of different letters of said alphabet; and, a list of provided clues comprising at least one clue wherein said at least one clue provides information with respect to an answer to be placed on said answer grid by said player.

2. A crossword puzzle game as recited in claim 1, wherein said additional indicia is a color within said at least one square.

3. A crossword puzzle game as recited in claim 1, wherein said additional indicia is a visual design located within said at least one square.

4. A crossword puzzle game as recited in claim 1, further comprising a key to provide said player with information with respect to the meaning of said added indicia.

5. A method of generating a crossword puzzle type game comprising the steps of:

generating a plurality of clues from each of which a player can determine a solution;

providing an answer grid upon which a player may indicate said solution to each of said plurality of provided clues, said answer grid comprising a plurality of interconnected squares wherein each of said squares is designed to contain one letter of at least one of said solutions;

determining a subset of an alphabet, said subset comprising a plurality of different letters of said alphabet;

placing added indicia within at least one of said squares of said answer grid, said added indicia indicating to said player that a letter to be placed in said at least one square including added indicia is to be selected from said subset;

whereby said player is assisted in determining the proper answer to at least one of said provided clues.

6. The method as recited in claim 5, wherein said step of providing an answer grid is carried out by printing said answer grid on paper, and wherein said step of placing added indicia in at least one of said squares is accomplished by coloring said at least one square with a particular color.

7. The method as recited in claim 5, wherein said step of providing an answer grid is carried out by printing said answer grid on paper, and wherein said step of placing added indicia in at least one of said squares is accomplished by placing a particular design within said at least one square.

8. The method as recited in claim 5, further comprising the step of generating a key that provides said player with the information regarding the meaning of said added indicia.

9. An improved crossword puzzle game of the type having an answer grid with a plurality of interconnected squares wherein each of said squares is designed to contain one letter of an answer to a provided clue, and having at least one provided clue wherein said at least one provided clue provides information with respect to an answer to be placed on said answer grid by a player, wherein the improvement comprises added indicia provided in association with at least one of said interconnected squares wherein said added indicia indicates that a letter to be placed in said at least one square is to be selected from a particular subset of an alphabet, said subset comprising a plurality of different letters of said alphabet.

10. An improved crossword puzzle game as recited in claim 9, wherein said added indicia is a color within said at least one square.

11. An improved crossword puzzle game as recited in claim 9, wherein said added indicia is a visual design located within said at least one square.

12. An improved crossword puzzle game as recited in claim 9, wherein the improvement further comprises a key to provide said player with information with respect to the meaning of said added indicia placed in said at least one square.

13. A crossword puzzle game as recited in claim 1, wherein said alphabet is the English alphabet, and wherein said subset comprises only vowels.

14. A crossword puzzle game as recited in claim 1, wherein said alphabet is the English alphabet, and wherein said subset comprises only consonants.

15. A crossword puzzle game as recited in claim 1, wherein said subset comprises each of the letters of a particular predetermined word.

16. A crossword puzzle game as recited in claim 1, wherein said answer grid and said list of provided clues are presented on an electronic display of a computer.

17. An improved crossword puzzle as recited in claim 9, wherein said alphabet is the English alphabet and wherein said subset comprises only vowels.

18. An improved crossword puzzle as recited in claim 9, wherein said alphabet is the English alphabet and wherein said subset comprises only consonants.

19. An improved crossword puzzle as recited in claim 9, wherein said answer grid is printed on paper.

20. A crossword puzzle comprising:

a plurality of written clues;

a solution to each of said plurality of clues, said solutions dissociated from said puzzle;

an answer grid having a plurality of interconnected squares wherein each of said squares is designed to contain one letter corresponding to a letter in said solution to each written clue, each solution corresponding to a finite number of squares in said answer grid; and, indicia associated with one or more if said squares to assist a player in determining that the letter of said solution corresponding to said square having indicia is to be selected from a particular subset of an alphabet, said subset comprising a plurality of different letters of said alphabet.

21. A crossword puzzle as recited in claim 20, further comprising an answer key having a plurality of squares identical to said answer grid, each square of said answer key containing a letter corresponding to a letter in said solution.

* * * * *